United States Patent [19]

Crandell

[11] 4,203,197

[45] May 20, 1980

[54] METHOD FOR MAKING A CERAMIC BOND HEATER

[75] Inventor: Walter R. Crandell, Addison, Ill.

[73] Assignee: Fast Heat Element Mfg. Co., Inc., Elmhurst, Ill.

[21] Appl. No.: 879,169

[22] Filed: Feb. 21, 1978

Related U.S. Application Data

[63] Continuation of Ser. No. 668,292, Mar. 18, 1976, abandoned.

[51] Int. Cl.[2] ..... H05B 3/00

[52] U.S. Cl. ..... 29/611; 29/613; 29/619; 219/535; 338/301; 338/311; 338/314

[58] Field of Search ..... 29/611, 610 R, 620, 29/613, 619; 219/535; 338/314, 301, 311; 428/54

[56] References Cited

U.S. PATENT DOCUMENTS

| | | | |
|---|---|---|---|
| 761,204 | 5/1904 | Carpenter | 29/611 |
| 1,042,432 | 10/1912 | Hadaway | 29/611 |
| 2,359,983 | 10/1944 | Fry | 219/464 |
| 2,957,227 | 10/1960 | Scott | 338/301 |
| 3,248,680 | 4/1966 | Ganci | 338/266 |
| 3,523,363 | 8/1970 | Kuwayama | 29/611 |
| 3,872,281 | 3/1975 | Krieg | 219/535 |

*Primary Examiner*—Francis S. Husar
*Assistant Examiner*—Gene P. Crosby

[57] ABSTRACT

An electric band heater of low expansion characteristics having an integral ceramic core with resistance wire sandwiched therein and encased within a metal housing, the core being formed from a wire wound ceramic sheet sandwiched between ceramic sheets; and a method for making such a heater which includes the steps of arranging an assembly of a wire wound organic-ceramic core strip between organic-ceramic insulator strips and placing the same within a metal housing, compressing and forming the assembly and then heating the assembly to bake out organic binder materials and sinter ceramic materials into a ceramic mass.

7 Claims, 5 Drawing Figures

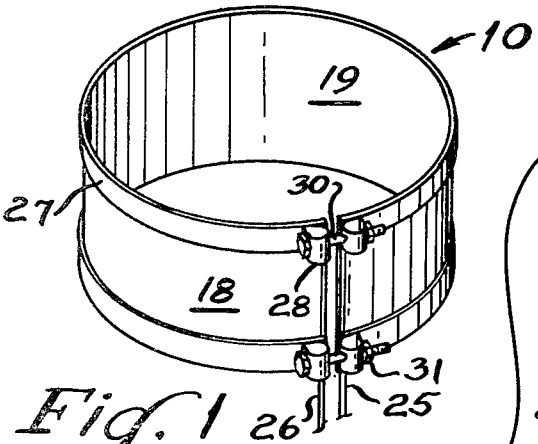
Fig. 1
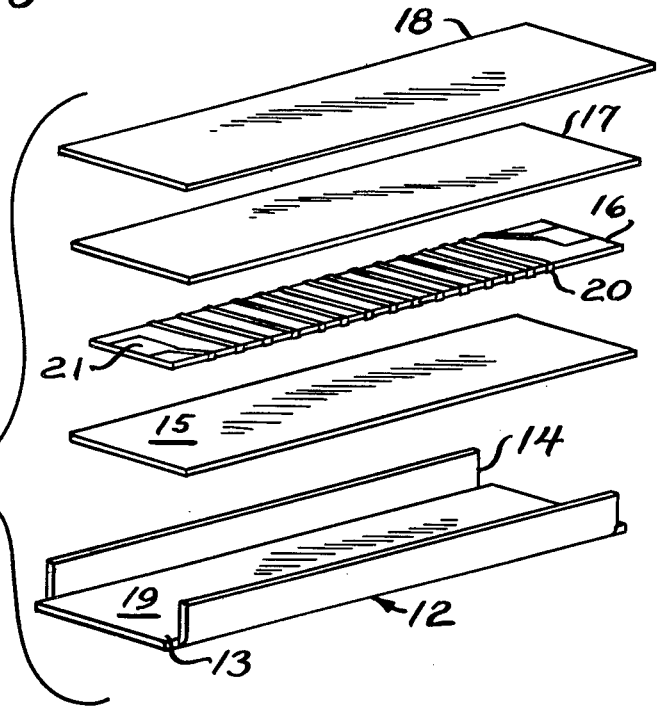
Fig. 2
Fig. 3
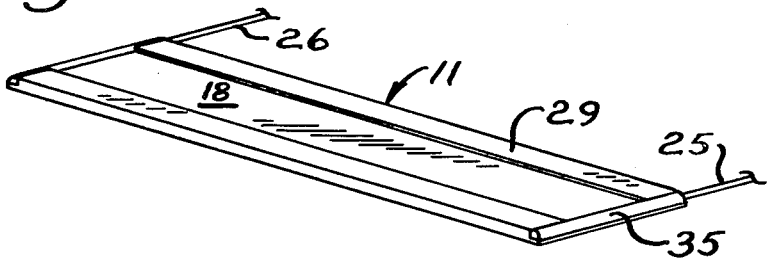
Fig. 4
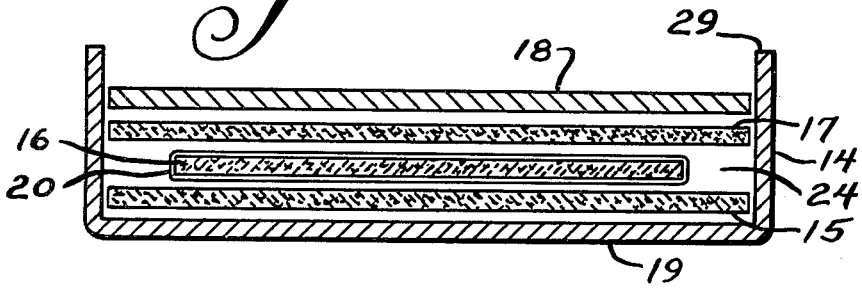
Fig. 5
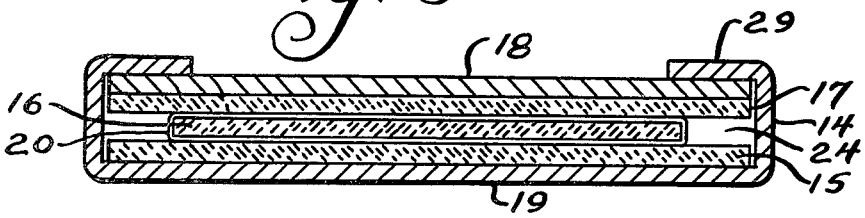

METHOD FOR MAKING A CERAMIC BOND HEATER

This is a continuation of application Ser. No. 668,292, filed Mar. 18, 1976, now abandoned.

BACKGROUND AND SUMMARY OF THE INVENTION

This invention relates to improvements in electric band or strip heaters, and is more particularly concerned with such heaters which include novel organic bound ceramic strips sandwiching a resistance wire wound organic—ceramic heater core element, forming a unitary sub-assembly in such a heater structure.

In conventional band heaters of standard mica configuration, a wire wound mice heating element is assembled between mica insulator strips. The resultant mica sandwich is then encased in a sheet metal enclosure and formed into a desired shape. The electrical mica insulators used are of relatively low thermal conductivity and thus limit the heat transfer efficiency. Also these insulator strips undergo physical and chemical changes upon exposure to temperatures in excess of 1200° F., which consist of dehydration or the baking out of the water of hydration. This change further decreases thermal conductivity and also reduces electrical insulating properties.

The presence of air voids and undesirable expansion under elevated temperature inherent in conventional mica heaters reduce heat transfer capability and result in loss of heater efficiency. These factors cause a conventional heater to operate at relatively higher than most efficient internal temperatures, resulting in premature heater failure. Additionally, where clamp force must be applied to maintain the heater in a given position, for example, around the nozzle of a tube having contents which must be heated as they pass therethrough, expansion of the heater under elevated temperatures causes loss of clamping force, resulting in heater inefficiency because the heater must be hotter to achieve a given surface temperature, and the higher temperature of the heater induces further expansion as the temperature is elevated.

In a second type of conventional band heater, coils of element wire are strung through ceramic insulator blocks which are shielded by a light sheet metal cover. Such an assembly is then strapped around an object to be heated. The resulting assembly can be likened to an oven assembly wherein heat transfer to the heated object is principally by convection rather than conduction. Such a heating system is not capable of high wattage because the inefficient convection heat transfer will not remove heat from the element wire fast enough, and thus would lead to over-temperaturing of the wire and premature element failure. This limitation of wattage thus increases heat up time of any object to be heated. Due to the open design of the casing for such conventional ceramic heaters, carbon forming materials can enter the heater, causing grounding type failures, which also may constitute a safety hazard. Also, inherent bulk requirements for such a heater, prevent the use of such conventional ceramic heaters in some applications where space is critical.

In the present invention, during fabrication of the heater, instead of a formed mica core and mica insulation strips, as in a conventional mica heater, and instead of a preformed wire strung ceramic block, as in a conventional ceramic heater, resistance wire is wound on a core strip of organically bound ceramic particles, which is sandwiched between similar organically bound ceramic strips, and the assembly is rolled or pressed in a metal housing to eliminate air voids between the elements, whereupon formation of the heater is completed and the entire assembly is heated to bake out the binders and sinter the ceramic particles into a unitary mass embedding therein the heater wire.

The novel organically bound ceramic particle strips each comprise a thin pliable 'green' sheet of ceramic particles, pressed and rolled to a high density, and bonded together with binder materials, usually organic in nature, to an overall thickness upwards of 0.018 inch. The ceramic particles in the sheets are typical powdered ceramic materials, such as particles of aluminum oxide, magnesium oxide, boron nitride, or silicone dioxide. The binders for the ceramic particles are typically silicone, rubber, varnish, glyptal or the like. These bonded 'green' or unbaked ceramic particle sheets conventionally are used in the fabrication of ceramic underlayment for printed circuits, the end product when baked out being referred to as "ceramic substrata", but in their 'green' state before baking they are pliable and bendable.

In fabricating a heater according to the present invention, a lower organic—ceramic strip is laid over the bottom wall of a U-shaped metal housing, and the core organic—ceramic strip which has been wound with Nichrome or other resistance wire is placed over the lower strip. A second or upper organic—ceramic insulator strip is placed over the wire wound core strip, and a metal pressure plate is installed over the upper strip to close the housing. The edges of the housing are bent over the pressure plate, and the assembly is then rolled and flattened, thereby eliminating air voids between the elements and amalgamating and unifying the structure.

The assembly may then be shaped, for example bent into a curved band heater. When the heater assembly is in its final finished shape, the entire assembly is fired at an elevated temperature above the vaporization point of the binder materials in the strips and below the melting point of the sheath covering, preferably in an oxygen atmosphere, to vaporize and carbonize the binders and oxidize the carbon, which is vented from the heater in the form of carbon dioxide. As a result of this process, the ceramic materials of the strips agglomerate into an integral heat conducting and electrically insulating mass. Leads may then be connected to the heater element terminals and any desired heater mounting members may then be attached.

OBJECTS OF THE INVENTION

It is therefore an object of the present invention to provide a novel electric heater assembly of the character referred to.

Another object is to provide novel bound ceramic particle strips for core and insulator members in an electric heater assembly.

Another object is to provide an electric heater assembly of the character referred to which may be conveniently formed to a desired thickness and shape without damaging its ceramic components.

Another object is to provide an electric heater assembly which may be compressed and fired to eliminate air voids and provide a unitary heater having low expansion and high heat transfer characteristics.

Another object is to provide an electric heater which is easy to manufacture and very efficient and economical in use.

These and other objects and advantages of the invention will become apparent as this description proceeds, particularly with reference to the following specification and accompanying drawings.

BRIEF DESCRIPTION OF THE DRAWINGS

In the drawings:

FIG. 1 is a perspective view of a curved band heater embodying the invention.

FIG. 2 is a perspective exploded view of the separated parts of a heater assembly embodying the invention.

FIG. 3 is a perspective view of a strip heater embodying the invention.

FIG. 4 is a sectional view of assembled parts of the heater before closing the housing and compression and heating of the assembly.

FIG. 5 is a sectional view of a completed heater assembly.

DESCRIPTION OF PREFERRED EMBODIMENTS

With reference to the drawings, a curved band heater 10 (as shown in FIG. 1) or a strip heater 11 (as shown in FIG. 3), is fabricated, preferably, from a sheet metal channel 12, having a flat base 19 and upstanding sides 14, into which is laid, successively, a thin flat pliable insulator sheet 15 of bound ceramic particles, a resistance wire wound core 16 of bound ceramic particles, a second or upper insulator sheet 17 of bound ceramic particles, and a metal pressure plate 18, all of which may be held together and centered during initial assembly by means of suitable tape or adhesive. The margins 29 of the upstanding sides 14 on channel 12 are bent over the pressure place 18 to close the assembly and bind the pressure plate thereover. The closed assembly is then rolled flat or is formed into a curved finished shape to compress the parts together and eliminate air voids between the elements, as shown in FIG. 5.

Core strip 16 is wound with Nichrome or other resistance wire 20, and the ends of the wire may be bound with terminal pads 21. The pressure plate 18 and the insulator strips 15 and 17 are of about the same length and width as the base 19 to fit snugly within the channel 12, but the core strip 16, while about the same length as the base 19, is substantially narrower than the strips 15 and 17, to provide a gap 24 for electrical clearance between the core strip 16, its winding of wire 20, and the channel sides 14.

The bound ceramic particle insulator sheets 15 and 17 and the core strip 16 each comprise high density ceramic particles bound together by a binder, usually organic material, which has been fabricated by pressing and rolling the material together. While the strips are green, i.e. before heating to the vapor point of the binder material and sintering of the ceramic particles, the strips are pliable and bendable, but after heating to a temperature above the vapor point of the organic or inorganic binder material and after sintering of the ceramic particles, the strips become semi-brittle and hard and amalgamate into a unitary mass to insulate the resistance wire 20 embedded therein, while providing efficient heat transfer and low expansion characteristics when a current is applied to the resistance wire.

Before heating and sintering, the assembly is bendable and formable without damaging the core 16 and insulator strips 15 and 17, so the assembly may be shaped, for example into the configuration of a curved band heater 10, shown in FIG. 1, or left in its extended form to be completed as a strip heater 11, shown in FIG. 3. After the forming step, the assembly is fired at an elevated temperature, preferably in an oxygen atmosphere, sufficient to vaporize and bake out the binder materials of the strips 15, 16 and 17 and to sinter the ceramic particles, binding them together into a single mass. The applied temperature for vaporization and sintering should be less than the melting point of the metal members, so as not to weaken those parts.

Electric leads 25 and 26, respectively, may be connected to each of the terminal pads 21, connecting the heater wires 20 to a power source. A slight extension 13 may be provided on each edge of the channel to support the lead wires, and the channel edges may be potted with suitable electrical cement 35 to close and finish the connection to the heater assembly.

Means for mounting or clamping the heater assembly to or about a surface to be heated may also be connected to the finished heater assembly. Such means may comprise a band 27, which may be spot welded to the pressure plate 18, having turned and apertured ends 30, through which apertures a bolt 30 may be inserted, and clamping may be accomplished by tightening a nut 31 on the bolt.

Although I have described and illustrated embodiments of the invention in considerable detail, terminal connections and lead wire arrangements other than as shown may be utilized and various other details of the invention may be changed or modified without departing from the spirit or scope of the invention. Accordingly, this specification is intended to be illustrative only, rather than restrictive, as I do not desire to be limited to the exact construction shown and described.

I claim:

1. In a method for fabricating a unitary electric ceramic band heater comprising the steps of assembling resistance wire on an uncured sheet of ceramic particles impregnated to a high density and bound together in heat dissipatable binder material, arranging said assembled wire and uncured sheet between uncured sheets of insulator particles bound together in heat dissipatable binder material, compressing said arranged assembled wire and uncured sheet and said uncured insulator sheets together to substantially eliminate air voids between said sheets, and heating said compressed arranged assembly at a temperature sufficient to substantially dissipate said binder materials and cure said ceramic and insulator particles into an integral mass.

2. The method recited in claim 1, wherein leads for electrically connecting said winding to a source of power are attached to the resistance wire after said assembly is heated.

3. The method recited in claim 1, wherein said arranged assembly is placed in a housing before the assembly is compressed, and the housing is compressed together with said assembly.

4. The method recited in claim 3, wherein said housing is closed before said compression step.

5. The method recited in claim 1, wherein said compressed assembly is formed before it is heated.

6. The method recited in claim 1, wherein means for mounting the assembly on a selected surface is connected to said assembly after the assembly is compressed and heated.

7. The method recited in claim 5, wherein said compressed assembly is bent into a curved shape.

* * * * *